US011454140B1

(12) United States Patent
McCloy et al.

(10) Patent No.: US 11,454,140 B1
(45) Date of Patent: Sep. 27, 2022

(54) TORQUE-LIMITING ROTOR COUPLING FOR AN ELECTRICALLY-ACTUATED CAMSHAFT PHASER

(71) Applicant: BorgWarner Inc., Auburn Hills, MI (US)

(72) Inventors: Chad M. McCloy, Cortland, NY (US); Daniel Scales, Dryden, NY (US)

(73) Assignee: BORGWARNER INC., Auburn Hills, MI (US)

( * ) Notice: Subject to any disclaimer, the term of this patent is extended or adjusted under 35 U.S.C. 154(b) by 0 days.

(21) Appl. No.: 17/522,304

(22) Filed: Nov. 9, 2021

(51) Int. Cl.
*F01L 1/352* (2006.01)
*F01L 1/46* (2006.01)
*F01L 13/00* (2006.01)

(52) U.S. Cl.
CPC ..... *F01L 1/352* (2013.01); *F01L 1/46* (2013.01); *F01L 2013/103* (2013.01); *F01L 2800/12* (2013.01); *F01L 2820/032* (2013.01)

(58) Field of Classification Search
CPC ..... F01L 1/352; F01L 1/46; F01L 2013/103; F01L 2800/12; F01L 2820/032
USPC ..... 123/90.15, 90.17
See application file for complete search history.

(56) References Cited

U.S. PATENT DOCUMENTS

| | | | | |
|---|---|---|---|---|
| 4,056,953 | A | 11/1977 | Furlette et al. | |
| 4,263,711 | A | 4/1981 | Sakano et al. | |
| 4,617,484 | A | 10/1986 | Buijsen | |
| 4,687,392 | A | 8/1987 | Bidwell | |
| 5,684,348 | A | 11/1997 | Main | |
| 6,443,846 | B1 | 9/2002 | Dziedzic et al. | |
| 6,608,421 | B1 | 8/2003 | Hamilton et al. | |
| 6,720,702 | B2 | 4/2004 | Knauff | |
| 6,948,464 | B2 | 9/2005 | Ido et al. | |
| 8,083,596 | B1 | 12/2011 | Silver et al. | |
| 9,810,108 | B2 | 11/2017 | Pritchard et al. | |
| 2009/0120388 | A1 | 5/2009 | Lee et al. | |
| 2012/0145104 | A1* | 6/2012 | David | F01L 1/352 123/90.17 |
| 2013/0312682 | A1 | 11/2013 | Schaefer et al. | |
| 2016/0245088 | A1 | 8/2016 | Jevardat De Fombelle et al. | |
| 2021/0270193 | A1* | 9/2021 | Ono | F01L 1/344 |

FOREIGN PATENT DOCUMENTS

| | | | |
|---|---|---|---|
| DE | 2638538 | A1 | 3/1978 |
| FR | 2497018 | A1 | 6/1982 |
| GB | 1533026 | A | 11/1978 |
| JP | 5873523 | B2 | 3/2016 |
| WO | WO2010-129539 | A2 | 11/2010 |
| WO | WO2012110131 | A1 | 8/2012 |

* cited by examiner

*Primary Examiner* — Jorge L Leon, Jr.
(74) *Attorney, Agent, or Firm* — Reising Ethington P.C.

(57) ABSTRACT

An electrically-actuated variable camshaft timing (VCT) assembly including an electric motor for controlling the VCT assembly having a rotor and a motor output shaft; a gearbox assembly having an input coupled to the motor output shaft and an output configured to be coupled with a camshaft of an internal combustion engine; and a torque-limiting assembly coupled to the motor output shaft that prevents angular displacement of the motor output shaft relative to the rotor and includes a spring that releasably engages the rotor to the motor output shaft to prevent angular displacement of the rotor relative to the motor output shaft at or below a torque limit and permits angular displacement of the rotor relative to the motor output shaft above the torque limit.

18 Claims, 5 Drawing Sheets

TORQUE-LIMITING ROTOR COUPLING FOR AN ELECTRICALLY-ACTUATED CAMSHAFT PHASER

TECHNICAL FIELD

The present application relates to electrical motors and, more particularly, to electrical motors used in electrically-actuated variable camshaft timing (VCT) devices—also called electrically-actuated camshaft phasers.

BACKGROUND

Internal combustion engines include camshafts that open and close valves regulating the combustion of fuel and air within combustion chambers of the engines. The opening and closing of the valves are carefully timed relative to a variety of events, such as the injection and combustion of fuel into the combustion chamber and the location of the piston relative to top-dead center (TDC). Camshaft(s) are driven by the rotation of the crankshaft via a drive member connecting these elements, such as a belt or chain. In the past, a fixed relationship existed between the rotation of the crankshaft and the rotation of the camshaft. However, internal combustion engines increasingly use camshaft phasers that vary the phase of camshaft rotation relative to crankshaft rotation. Variable camshaft timing (VCT) devices—camshaft phasers—can, in some implementations, be actuated by electric motors that advance or retard the opening/closing of valves relative to crankshaft rotation.

The electrically-actuated camshaft phasers can include an electric motor and a gearbox having an input and an output. The output of the gearbox can be coupled to a camshaft while the input can be coupled to an output shaft of the electric motor. The electric motor can include an output shaft that is coupled with a rotor of the electric motor and the input of the gearbox. During operation, the electrically-actuated camshaft phasers can have a range of operation, or angular displacement of the camshaft relative to the crankshaft.

SUMMARY

In one implementation, an electrically-actuated variable camshaft timing (VCT) assembly including an electric motor for controlling the VCT assembly having a rotor and a motor output shaft; a gearbox assembly having an input coupled to the motor output shaft and an output configured to be coupled with a camshaft of an internal combustion engine; and a torque-limiting assembly coupled to the motor output shaft that prevents angular displacement of the motor output shaft relative to the rotor and includes a spring that releasably engages the rotor to the motor output shaft to prevent angular displacement of the rotor relative to the motor output shaft at or below a torque limit and permits angular displacement of the rotor relative to the motor output shaft above the torque limit.

In another implementation, an electrically-actuated VCT assembly including an electric motor for controlling the VCT assembly having a rotor and a motor output shaft; a gearbox assembly having an input coupled to the motor output shaft and an output configured to be coupled with a camshaft of an internal combustion engine; and a torque-limiting assembly including a rotor plate having a radially-outwardly-extending flange with an axial surface that is axially biased into releasable engagement with an axial face of the rotor, wherein the rotor plate couples with the motor output shaft so that the rotor plate maintains in a fixed relative angular position of the rotor relative to the motor output shaft.

In yet another implementation, an electrically-actuated VCT assembly including an electric motor for controlling the VCT assembly having a rotor and a motor output shaft; a gearbox assembly having an input coupled to the motor output shaft and an output configured to be coupled with a camshaft of an internal combustion engine; and a torque-limiting assembly coupled to the motor output shaft that prevents angular displacement of the motor output shaft relative to the rotor and includes a rotor plate that is fixed to the rotor, wherein the rotor plate includes one or more frictional surfaces that releasably engage the rotor to the motor output shaft to prevent angular displacement of the rotor relative to the motor output shaft at or below a torque limit and permits angular displacement of the rotor relative to the motor output shaft above the torque limit.

DETAILED DESCRIPTION

Figure 1:
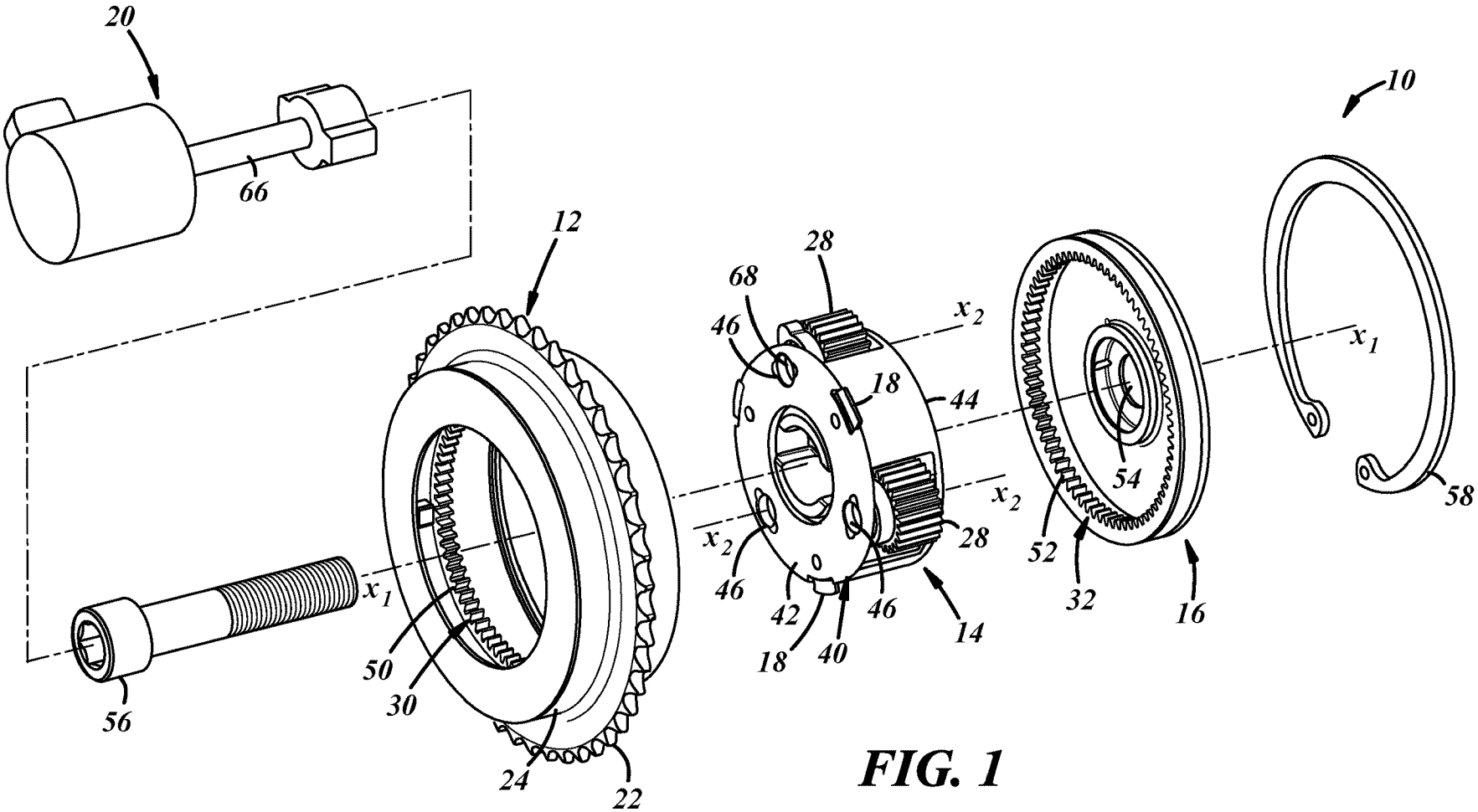
FIG. 1 is an exploded view depicting an implementation of an electrically-actuated VCT assembly.

Electrically-actuated variable camshaft timing (VCT) assemblies—sometimes referred to as camshaft phasers—use electric motors that control the angular position of a camshaft relative to a crankshaft. The electric motors commonly drive a gearbox assembly that communicates angular motion of a motor output shaft through an input of the gearbox assembly to an output of the gearbox assembly ultimately coupled with the camshaft. The motor output shaft can also be coupled with a rotor that is received by a stator inside of the electric motor. When electric current is received by the electric motor, the rotor is induced to move angularly relative to the stator. During operation, the electrically-actuated camshaft phaser can have a range of authority or the range of angular displacement of the camshaft relative to the crankshaft. As the electrically-actuated camshaft phaser approaches an end of the range, mechanical stops included in the phaser can prevent angular displacement of the camshaft relative to the crankshaft beyond the range. As the electrically-actuated camshaft phaser reaches and engages the stops, significant increases in torque can be transmitted through the gearbox assembly to the motor output shaft and the electric motor. If the torque is significant enough, components of the electrically-actuated camshaft phaser can be damaged. Features that relieve and/or release the loads as the electrically-actuated camshaft phaser reaches the limit of the range of authority and engages the stops can help preserve the functionality of the phaser.

A torque-limiting assembly between the rotor and the motor output shaft can prevent angular displacement between the motor shaft and the rotor below a defined torque limit and permit angular displacement between the motor shaft and the rotor at or above the defined torque limit that could be reached or exceeded when the camshaft phaser reaches and engages the stops limiting the range of authority. In some implementations, the torque-limiting assembly can include a rotor plate and an axial spring. The rotor plate can be fixed to the motor output shaft in a way that prevents angular displacement of the plate relative to the shaft. The rotor plate can have a radially-outwardly extending flange having an axial surface that releasably engages an axial face of the rotor. The axial surface of the rotor plate can include surface features that are shaped to conform to other shaped features included on the axial face of the rotor. The axial spring can bias the rotor plate in the direction of an axis of shaft rotation into engagement with the axial face of the rotor. As the electric motor controls the electrically-actuated camshaft phaser within the range of authority, the rotor plate, biased by the spring into engagement with the rotor, can maintain the angular position of the motor output shaft relative to the rotor. When the torque limit is reached, the axial surface of the rotor plate can be angularly displaced relative to the axial face of the rotor to limit the amount of torque that can be transmitted from the gearbox assembly to the electric motor. Once the torque applied to the motor output shaft falls below the torque limit, the spring can, once again, bias the rotor plate back into engagement with the rotor to prevent the angular displacement of the rotor plate relative to the rotor, thereby preventing the angular displacement of the motor output shaft relative to the rotor.

Figure 2:
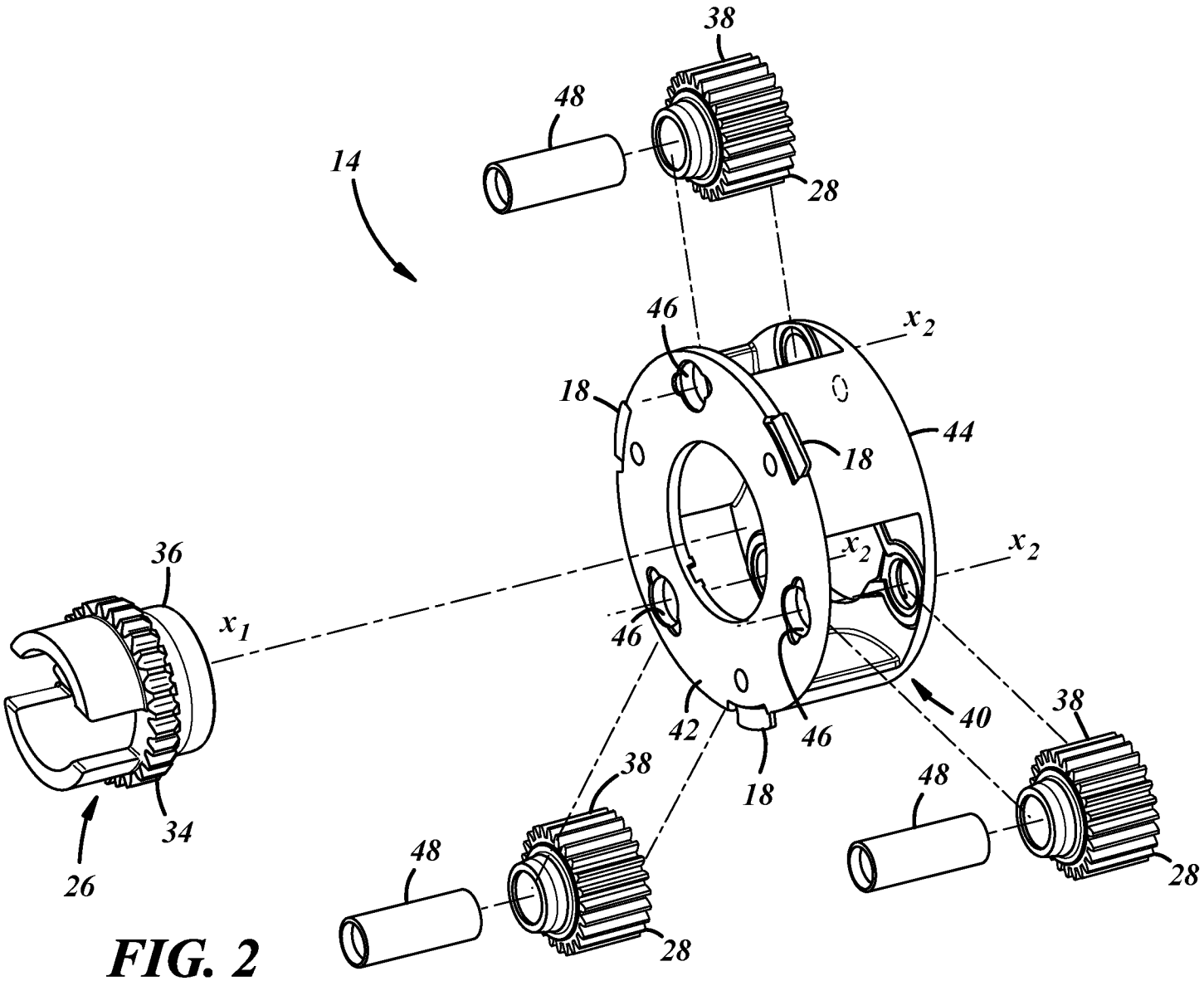
FIG. 2 is an exploded view depicting an implementation of a portion of an electrically-actuated VCT assembly.

An embodiment of an electrically-actuated camshaft phaser 10 is shown with respect to FIGS. 1-2. The phaser 10 is a multi-piece mechanism with components that work together to transfer rotation from the engine's crankshaft and to the engine's camshaft, and that can work together to angularly displace the camshaft relative to the crankshaft for advancing and retarding engine valve opening and closing. The phaser 10 can have different designs and constructions depending upon, among other possible factors, the application in which the phaser is employed and the crankshaft and camshaft that it works with. In the embodiment presented in FIGS. 1-2, for example, the phaser 10 includes a sprocket 12, a planetary gear assembly 14, an inner plate 16, and an electric motor 20.

The sprocket 12 receives rotational drive input from the engine's crankshaft and rotates about an axis $X_1$. A timing chain or a timing belt can be looped around the sprocket 12 and around the crankshaft so that rotation of the crankshaft translates into rotation of the sprocket 12 via the chain or belt. Other techniques for transferring rotation between the sprocket 12 and crankshaft are possible, such as a geared valvetrain. Along an outer surface, the sprocket 12 has a set of teeth 22 for mating with the timing chain, with the timing belt, or with another component. In different examples, the set of teeth 22 can include thirty-eight individual teeth, forty-two individual teeth, or some other quantity of teeth spanning continuously around the circumference of the sprocket 12. As illustrated, the sprocket 12 has a housing 24 spanning axially from the set of teeth 22. The housing 24 is a cylindrical wall that surrounds parts of the planetary gear assembly 14.

In the embodiment presented here, the planetary gear assembly 14 includes a sun gear 26, planet gears 28, a first ring gear 30, a second ring gear 32. The sun gear 26 is driven by the electric motor 20 for rotation about the axis $X_1$. The sun gear 26 engages with the planet gears 28 and has a set of teeth 34 at its exterior that makes direct teeth-to-teeth meshing with the planet gears 28. In different examples, the set of teeth 34 can include twenty-six individual teeth, thirty-seven individual teeth, or some other quantity of teeth spanning continuously around the circumference of the sun gear 26. A skirt 36 in the shape of a cylinder spans from the set of teeth 34. As described, the sun gear 26 is an external spur gear, but could be another type of gear.

The planet gears 28 rotate about their individual rotational axes $X_2$ when in the midst of bringing the engine's camshaft among advanced and retarded angular positions. When not advancing or retarding, the planet gears 28 revolve together around the axis $X_1$ with the sun gear 26 and with the ring gears 30, 32. In the embodiment presented here, there are a total of three discrete planet gears 28 that are similarly designed and constructed with respect to one another, but there could be other quantities of planet gears such as two or four or six. However many there are, each of the planet gears 28 can engage with both of the first and second ring gears 30, 32, and each planet gear can have a set of teeth 38 along its exterior for making direct teeth-to-teeth meshing with the ring gears. In different examples, the teeth 38 can include twenty-one individual teeth, or some other quantity of teeth spanning continuously around the circumference of each of the planet gears 28. To hold the planet gears 28 in place and support them, a carrier assembly 40 can be provided. The carrier assembly 40 can have different designs and constructions. In the embodiment presented in the figures, the carrier assembly 40 includes a first carrier plate 42 at one end, a second carrier plate 44 at the other end, and cylinders 46 that serve as a hub for the rotating planet gears 28. Planet pins or bolts 48 can be used with the carrier assembly 40.

The first ring gear 30 receives rotational drive input from the sprocket 12 so that the first ring gear 30 and sprocket 12 rotate together about the axis $X_1$ in operation. The first ring gear 30 can be a unitary extension of the sprocket 12—that is, the first ring gear 30 and the sprocket 12 can together form a monolithic structure. The first ring gear 30 has an annular shape, engages with the planet gears 28, and has a set of teeth 50 at its interior for making direct teeth-to-teeth meshing with the planet gears 28. In different examples, the teeth 50 can include eighty individual teeth, or some other quantity of teeth spanning continuously around the circumference of the first ring gear 30. In the embodiment presented here, the first ring gear 30 is an internal spur gear, but could be another type of gear.

The second ring gear 32 transmits rotational drive output to the engine's camshaft about the axis $X_1$. In this embodiment, the second ring gear 32 drives rotation of the camshaft via the plate 16. The second ring gear 32 and plate 16 can be connected together in different ways, including by a cutout-and-tab interconnection, press-fitting, welding, adhering, bolting, riveting, or by another technique. In embodiments not illustrated here, the second ring gear 32 and the plate 16 could be unitary extensions of each other to make a monolithic structure. Like the first ring gear 30, the second ring gear 32 has an annular shape, engages with the planet gears 28, and has a set of teeth 52 at its interior for making direct teeth-to-teeth meshing with the planet gears. In different examples, the teeth 52 can include seventy-seven individual teeth, or some other quantity of teeth spanning continuously around the circumference of the second ring gear 32. With respect to each other, the number of teeth between the first and second ring gears 30, 32 can differ by a multiple of the number of planet gears 28 provided. So, for instance, the teeth 50 can include eighty individual teeth, while the teeth 52 can include seventy-seven individual teeth—a difference of three individual teeth for the three planet gears 28 in this example. In another example with six planet gears, the teeth 50 could include seventy individual teeth, while the teeth 52 could include eighty-two individual teeth. Satisfying this relationship furnishes the advancing and retarding capabilities by imparting relative rotational movement and relative rotational speed between the first and second ring gears 30, 32 in operation. In the embodiment presented here, the second ring gear 32 is an internal spur gear, but could be another type of gear. The plate 16 includes a central aperture 54 through which a center bolt 56 passes to fixedly attach the plate 16 to the camshaft. In addition, the plate 16 is also be secured to the sprocket 12 with a snap ring 58 that axially constrains the planetary gear assembly 14 between the sprocket 12 and the plate 16. The assembly includes mechanical stops 18 that can be used to limit the range of authority or angular displacement of the input relative to the output.

Together, the two ring gears 30, 32 constitute a split ring gear construction for the planetary gear assembly 14. However, other implementations of electrically-controlled camshaft phasers could be used with the torque-limiting assembly. For example, the planetary gear assembly 14 could include an eccentric shaft and a compound planet gear used with first and second ring gears or a harmonic drive system could be used.

Figure 3:
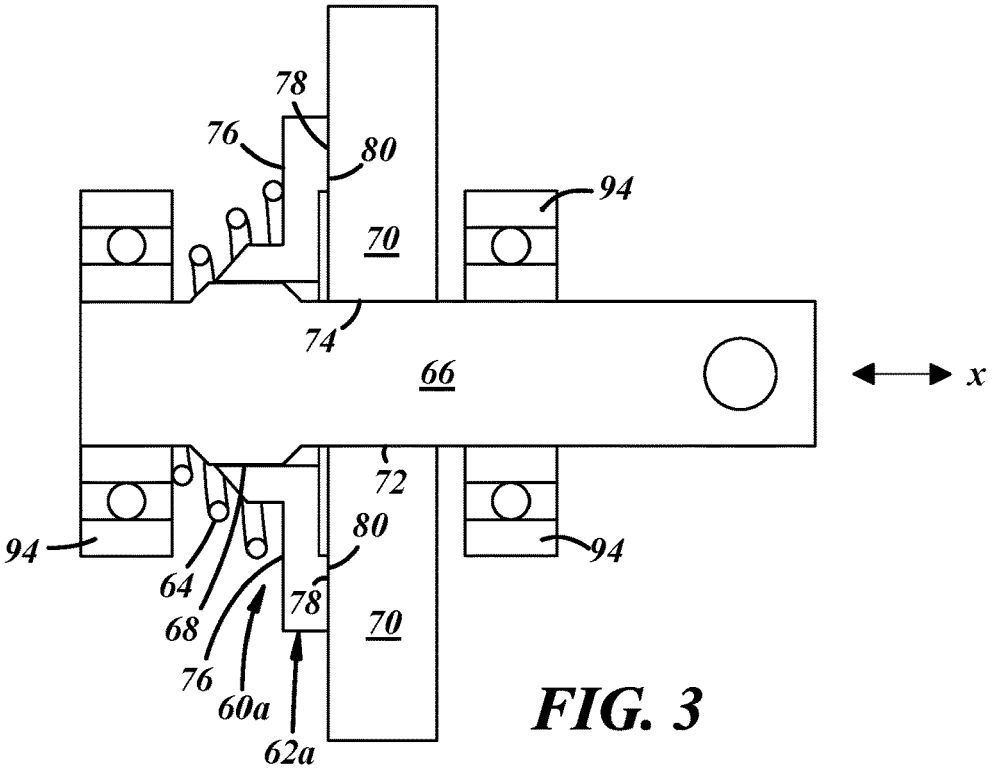
FIG. 3 is a cross-sectional view depicting an implementation of a torque-limiting assembly.
Figure 4:
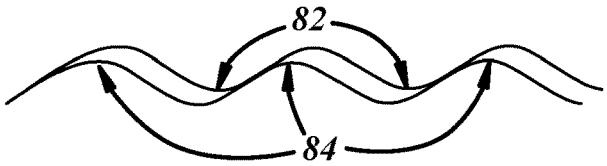
FIG. 4 is a profile view depicting an implementation of a portion of a torque-limiting assembly.

Turning to FIG. 3, an implementation of a torque-limiting assembly 60*a* is shown. The assembly 60*a* includes a rotor plate 62*a* and an axial spring 64. The rotor plate 62*a* can be fixed to a motor output shaft 66 using a splined outer surface of the shaft 66 that engages an inner diameter 68 of the rotor plate 62*a*. The inner diameter 68 can include radially-inwardly-facing teeth that conform to the splined outer surface of the shaft 66. The combination of the splined outer surface and radially-inwardly-facing teeth can prevent the angular displacement of the motor output shaft 66 relative to the rotor plate 62*a*. A rotor 70 of the electric motor 20 can include an inner diameter 72 that closely conforms to the outer surface 74 of the motor output shaft 66. The inner diameter 72 and outer surface 74 can freely move relative to each other to permit angular displacement of the rotor 70 relative to the motor output shaft 66. The rotor plate 62*a* can have one or more flanges 76 that extend radially-outwardly away from an axis of shaft rotation (x). The flange(s) 76 can have an axial surface 78 facing an axial face 80 of the rotor 70 that releasably engages the axial face 80. The axial surface 78 can include axially-extending flange teeth 82 that engage corresponding axially-extending rotor teeth 84 formed on an axial face 80 of the rotor 70 as are shown in FIG. 4. The flange(s) 76 of the rotor plate 62*a* and the axial face 80 of the rotor 70 can be configured to implement the teeth 82 as components of a Hirth coupling or a face-spline connection to provide a torque detent. However, it should be appreciated that other implementations of surface features on the rotor plate 62*a* and the rotor 70 to implement the torque limit are possible. For example, a laser-etched surface can be applied to the axial surface of the flanges and the axial face of the rotor such that when the surfaces are biased into engagement with each other the surfaces can prevent angular displacement of the rotor plate relative to the motor output shaft yet permit angular displacement at or above the torque limit.

The motor output shaft 66 can be supported by motor bearings 94 that can be axially-spaced on opposite sides of the rotor plate 62*a*. The axial spring 64 can be positioned to engage an axial face of a motor bearing 94 and a portion of the rotor plate 62*a*. In this implementation, the axial spring 64 is a coil spring. However, the term "spring" should be broadly interpreted as a biasing member and it should be appreciated that other types of biasing members could be used to implement axial springs. For example, a leaf spring could alternatively be used to implement the axial spring. Or in another implementation, a bearing can be press-fit onto the motor output shaft to prevent the angular displacement of the bearing relative to the shaft; the rotor plate in this implementation could be implemented as a Belleville washer that can be fixed to the inner race of the bearing.

Figure 5:
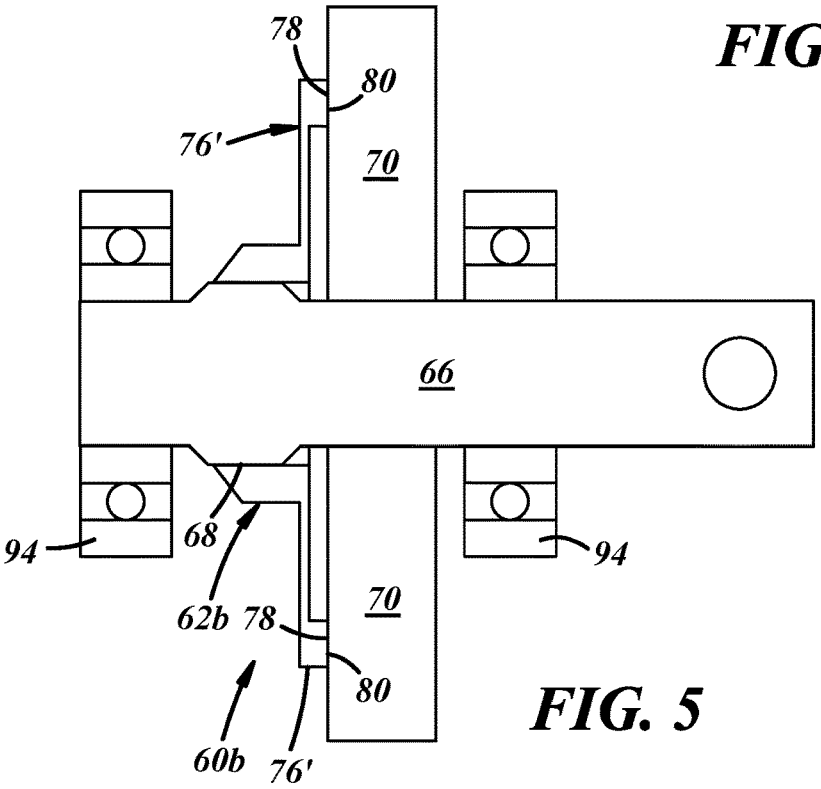
FIG. 5 is a cross-sectional view depicting an implementation of a torque-limiting assembly.

FIG. 5 depicts another implementation of the torque-limiting assembly 60*b*. The assembly 60*b* includes a rotor plate 62*b* having an integrated axial spring. Radially-outwardly-extending flanges 76' can include a pre-bend that biases the flanges 76' into engagement with the axial face 80 of the rotor 70. The rotor plate 62*b* can be fixed to the motor output shaft 66 to prevent angular displacement of the plate 62*b* relative to the shaft 66. In this embodiment, the rotor plate 62*b* can be fixed to the motor output shaft 66 via the spline, or the two components could be press fit or welded together.

Figure 6:
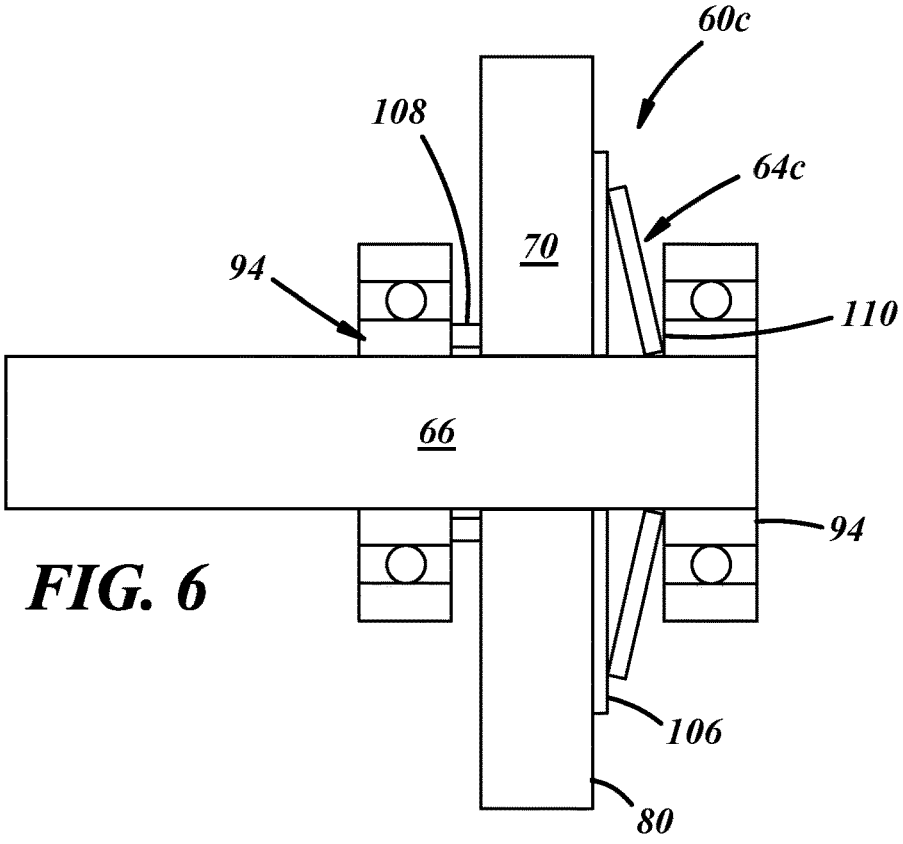
FIG. 6 is a cross-sectional view depicting an implementation of a torque-limiting assembly.

FIG. 6 depicts yet another implementation of the torque-limiting assembly 60*c*. The assembly 60*c* can include an axial spring 64*c* that is implemented as a Belleville washer or conical spring washer. The rotor 70 can include a friction plate 106 affixed to the axial face 80 of the rotor 70. The friction plate 106 can be made of a material having a higher coefficient of friction than the rotor material. A spacer 108 can be positioned axially between the rotor 70 and a motor bearing 94 to help align the rotor 70 with a stator or to provide a frictional surface the rotor 70 can engage. The axial spring 64*c* can engage the friction plate 106 and an axial face 110 of the motor bearing 94. The axial force exerted by the spring 64*c* on the friction plate 106 and the motor bearing 94 can define the torque limit above which the rotor 70 will be angularly displaced relative to the motor output shaft 66. In some implementations, the axial face 110 of the motor bearing 94 can include a surface having an increased coefficient of friction relative to other outer surfaces of the motor bearing 94. When a torque level applied to the motor output shaft 66 rises above a threshold, the spring 64*c* can move relative to the friction plate 106 and the rotor 70 can be angularly displaced relative to the shaft 66. Once the torque level applied to the motor output shaft 66 falls below the threshold, the spring 64*c* can once again prevent angular displacement of the shaft 66 relative to the rotor 70.

Figure 7:
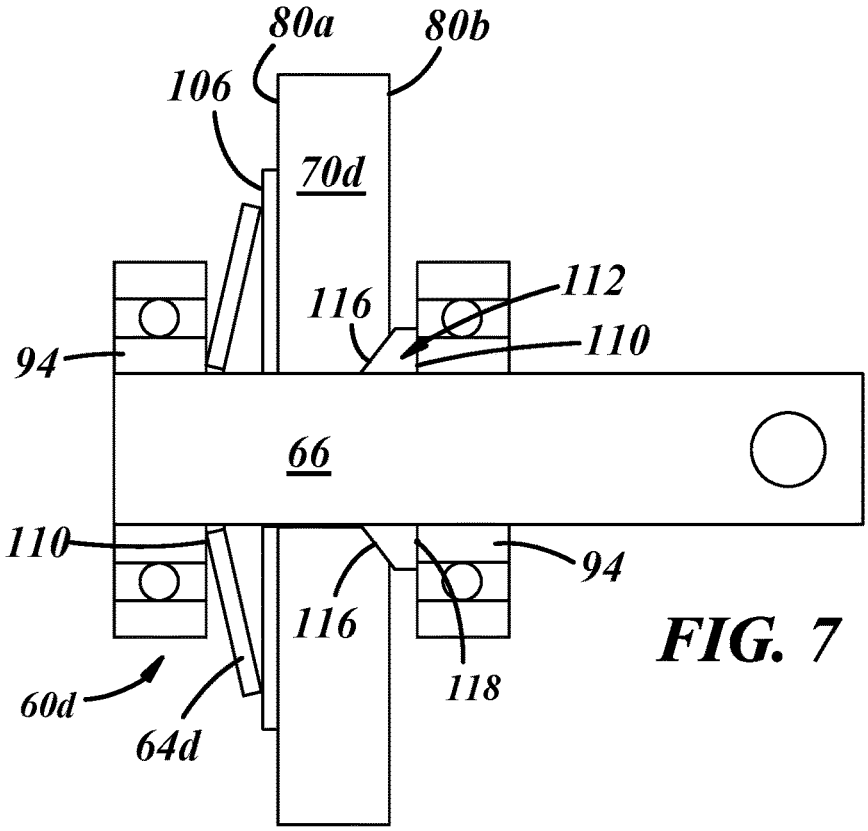
FIG. 7 is a cross-sectional view depicting an implementation of a torque-limiting assembly.

FIG. 7 depicts another implementation of the torque-limiting assembly 60*d*. The assembly 60*d* includes an axial spring 64*d*, a rotor 70*d*, and a conical friction spacer 112. The axial spring 64*d* can be implemented as a Belleville washer or conical spring washer. The rotor 70*d* can include a friction plate 106 on one axial face 80*a* of the rotor 70*d*. The axial spring 64*d* can engage the friction plate 106 and an axial face 110 of the motor bearing 94. The axial force exerted by the spring 64*d* on the friction plate 106 and the motor bearing 94 can partially define the torque threshold above which the rotor 70 will be angularly displaced relative to the motor output shaft 66. Another axial face 80*b* of the rotor 70*d* can include a conical feature 116. The conical feature 116 can have a conical or frustoconical surface with a coefficient of friction that is higher than other areas of the axial face 80*b*. The conical friction spacer 112 can have a corresponding surface that closely fits into and is received by the conical feature 116. The surface of the conical friction spacer 112 that engages the conical feature 116 can also include an increased coefficient of friction and partially define the torque threshold. The conical friction spacer 112 can have an axial face 118 that abuts and engages an axial face 110 of a motor bearing 94. The axial force exerted by the spring 64*d* on the friction plate 106 and the conical friction spacer 112 can collectively define the torque limit above which the rotor 70*d* will be angularly displaced relative to the motor output shaft 66. When a torque level applied to the motor output shaft 66 rises above a threshold, the spring 64*c* can move relative to the friction plate 106 and/or the rotor 70*d* can move relative to the conical friction spacer 112; the rotor 70*d* can be angularly displaced relative to the shaft 66. Once the torque level applied to the motor output shaft 66 falls below the threshold, the spring 64*d* can once again prevent angular displacement of the shaft 66 relative to the rotor 70.

Figure 8:
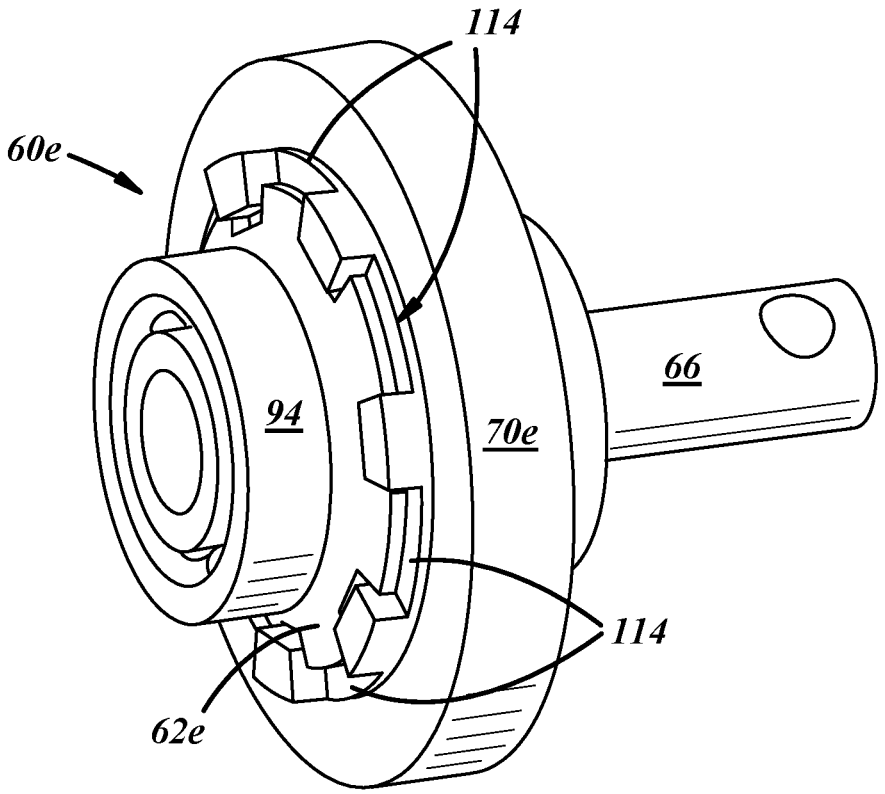
FIG. 8 is a perspective view depicting an implementation of a torque-limiting assembly.

Turning to FIG. 8, another implementation of the torque-limiting assembly 60*e* is shown. The assembly 60*e* includes a rotor plate 62*e* and a rotor 70*e*. In this implementation, the rotor plate 62*e* can be shaped to engage slots 114 formed in the rotor 70*e* to prevent the plate 62*e* from being angularly displaced relative to the rotor 70*e*. The rotor plate 62*e* can include an inner diameter having a surface with an increased coefficient of friction that engages the motor output shaft 66. Additionally, or alternatively, an axial face 80 of the rotor 70*e* can engage an axial face of the motor bearing 94 either of which can include a frictional surface. The rotor 70*e* can turn and transmit torque to the motor output shaft 66 through the rotor plate 62*e*. When a torque level applied to the motor output shaft 66 rises above a threshold, the frictional surface of the inner diameter of the rotor plate 62*e* and/or the frictional surface(s) between the rotor 70*e* and the motor bearing 94 can move relative to each other permitting angular displacement of the motor shaft 66 relative to the rotor 70*e*. Once the torque level applied to the motor output shaft 66 falls below the threshold, the frictional surface of the inner diameter and/or the rotor 70*e* and the motor bearing 94 can once again prevent angular displacement of the shaft 66 relative to the rotor 70*e*.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. An electrically-actuated variable camshaft timing (VCT) assembly, comprising:

an electric motor configured to control the VCT assembly, the electric motor including a rotor and a motor output shaft;

a gearbox assembly comprising an input coupled to the motor output shaft, and an output configured to be coupled to a camshaft of an internal combustion engine; and a torque-limiting assembly coupled to the motor output shaft, the torque-limiting assembly configured to:

releasably couple the rotor to the motor output shaft so as to prevent angular displacement of the rotor relative to the motor output shaft when a torque applied to the motor output shaft is less than or equal to a torque limit, and decouple the rotor from the motor output shaft so as to permit angular displacement of the rotor relative to the motor output shaft when the torque applied to the motor output shaft is greater than the torque limit.

2. The electrically-actuated VCT assembly recited in claim 1, wherein the torque-limiting assembly comprises a rotor plate.

3. The electrically-actuated VCT assembly recited in claim 2, wherein the rotor plate comprises a detent including teeth.

4. The electrically-actuated VCT assembly recited in claim 1, wherein the torque-limiting assembly comprises an axial spring configured to bias a rotor plate toward the rotor so as to enable the releasable coupling of the rotor to the motor output shaft.

5. The electrically-actuated VCT assembly recited in claim 4, wherein the axial spring is a Belleville washer.

6. The electrically-actuated VCT assembly recited in claim 1, wherein the gearbox assembly further comprises one or more mechanical stops.

7. The electrically-actuated VCT assembly recited in claim 1, wherein the torque-limiting assembly comprises a conical friction spacer configured to engage a conical recess in the rotor.

8. The electrically-actuated VCT assembly recited in claim 1, further comprising wherein the torque-limiting assembly comprises a friction plate applied to an axial face of the rotor.

9. The electrically-actuated VCT assembly recited in claim 1, further comprising one or more spacers positioned axially between the rotor and a motor bearing.

10. The electrically-actuated VCT assembly recited in claim 1, wherein the torque-limiting assembly comprises a spring configured to engage an axial face of a motor bearing.

11. An electrically-actuated variable camshaft timing (VCT) assembly, comprising:

an electric motor configured to control the VCT assembly, the electric motor including a rotor and a motor output shaft;

a gearbox assembly comprising an input coupled to the motor output shaft, and an output configured to be coupled to a camshaft of an internal combustion engine; and a torque-limiting assembly comprising:

a rotor plate coupled to the motor output shaft such that the rotor plane maintains a fixed angular position relative to the motor output shaft, the rotor including a radially-outwardly-extending flange with an axial surface that is axially biased into releasable engagement with an axial face of the rotor.

12. The electrically-actuated VCT assembly recited in claim 11, wherein the torque-limiting assembly further comprises an axial spring.

13. The electrically-actuated VCT assembly recited in claim 11, wherein the rotor plate further includes an integrated spring.

14. The electrically-actuated VCT assembly recited in claim 11, further comprising a friction plate applied to the axial face of the rotor.

15. An electrically-actuated variable camshaft timing (VCT) assembly, comprising:

an electric motor configured to control the VCT assembly, the electric motor including a rotor and a motor output shaft;

a gearbox assembly comprising an input coupled to the motor output shaft, and an output configured to be coupled to a camshaft of an internal combustion engine; and a torque-limiting assembly comprising a rotor plate fixed to the rotor, the rotor plate including one or more frictional surfaces configured to:

releasably couple the rotor to the motor output shaft so as to prevent angular displacement of the rotor relative to the motor output shaft when a torque applied to the motor output shaft is less than or equal to a torque limit, and decouple the rotor from the motor output shaft so as to permit angular displacement of the rotor relative to the motor output shaft when the torque applied to the motor output shaft is greater than the torque limit.

16. The electrically-actuated VCT assembly recited in claim 15, wherein the rotor comprises one or more slots that engage with the rotor plate so as to prevent angular displacement of the rotor relative to the rotor plate.

17. The electrically-actuated VCT assembly recited in claim 15, wherein the one or more frictional surfaces are applied to an inner diameter of the rotor plate or an outer diameter of the motor output shaft.

18. The electrically-actuated VCT assembly recited in claim 15, wherein the one or more frictional surfaces are applied to an axial surface of a motor bearing or an axial surface of the rotor plate.

* * * * *